US010947476B2

(12) United States Patent
Lu et al.

(10) Patent No.: US 10,947,476 B2
(45) Date of Patent: Mar. 16, 2021

(54) POLYFLUORO LUBRICANT COMPOSITIONS

(71) Applicant: Seagate Technology LLC, Cupertino, CA (US)

(72) Inventors: Yu Lu, Milpitas, CA (US); JiPing Yang, San Jose, CA (US); Jingyuan Zhuo, San Jose, CA (US); Qian Guo, Fremont, CA (US); Wen H. Liu, San Jose, CA (US)

(73) Assignee: SEAGATE TECHNOLOGY LLC, Fremont, CA (US)

( * ) Notice: Subject to any disclaimer, the term of this patent is extended or adjusted under 35 U.S.C. 154(b) by 269 days.

(21) Appl. No.: 16/025,954

(22) Filed: Jul. 2, 2018

(65) Prior Publication Data

US 2020/0002640 A1 Jan. 2, 2020

(51) Int. Cl.

| | |
|---|---|
| ***C10M 169/04*** | (2006.01) |
| ***C10M 147/04*** | (2006.01) |
| ***C10M 107/38*** | (2006.01) |
| *C10N 40/18* | (2006.01) |

(52) U.S. Cl.

CPC ..... *C10M 147/04* (2013.01); *C10M 107/38* (2013.01); *C10M 2213/04* (2013.01); *C10M 2213/043* (2013.01); *C10N 2040/18* (2013.01)

(58) Field of Classification Search

CPC ..... C10M 147/04; C10M 107/38; C10M 2213/043; C10M 2213/04; C10M 105/54; C10M 2211/0425; C10N 2040/18

USPC ..... 508/582

See application file for complete search history.

(56) References Cited

U.S. PATENT DOCUMENTS

| | | | | |
|---|---|---|---|---|
| 4,721,795 | A | 1/1988 | Caporiccio et al. | |
| 6,660,886 | B1 | 12/2003 | Liu et al. | |
| 7,674,858 | B2 | 3/2010 | Morikawa et al. | |
| 2010/0240559 | A1* | 9/2010 | Shirakawa | C08G 65/337 508/582 |
| 2017/0365287 | A1 | 12/2017 | Yang | |

* cited by examiner

*Primary Examiner* — Prem C Singh
*Assistant Examiner* — Francis C Campanell
(74) *Attorney, Agent, or Firm* — Holzer Patel Drennan

(57) ABSTRACT

Provided herein is a lubricant comprising a compound of Formula I:

wherein $R_1$ and $R_2$ are independent and have the structure selected from —$(CF_2O)_x(CF_2CF_2O)_y(CF_2CF_2CF_2O)_z(CF_2CF_2CF_2CF_2O)_w$—, x, y, z and w are selected from an integer from 0 to 30;

p, and q are selected from an integer from 0 to 3;

A and B are independent and have the structure selected from: —$(CH_2CH(OH)CH_2O)_jH$, and j is an integer selected from 0 to 3.

12 Claims, 7 Drawing Sheets

POLYFLUORO LUBRICANT COMPOSITIONS

BACKGROUND

High-performance lubricants are used in a large number of diverse applications. The requirements of these lubricants are becoming more demanding due to a variety of factors, including increased miniaturization of electronic and mechanical devices, higher-temperature operating conditions, increased expectations for product lifetimes, and expanded ranges of operating and storage environments.

One application in which high-performance lubricants are subject to ever-increasing demands is in magnetic recording apparatuses including in hard disk drives. In hard disk drives, read and write heads are used to magnetically read and write information to and from the storage media. A standard hard disk drive includes the features of a slider which carries a read/write head, and radially floats over the recording surface of the disk under the control of a servo control system that selectively position the head over a specific track of the disk. Lubricants are required to prevent friction between the read/write head and the disk surface. Some lubricants for hard disk drives include polyfluoropolyethers (PFPE). There remains, however, a need for optimizing PFPE lubricants to meet ever-increasing demands.

SUMMARY OF THE INVENTION

Provided herein is a polyfluoro lubricant composition comprising one or more compounds of Formula I:

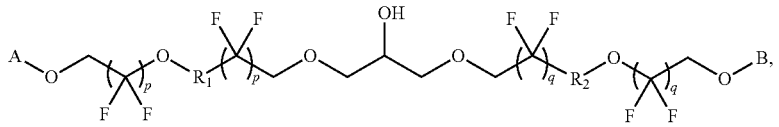

wherein $R_1$ and $R_2$ are independent and have the structure selected from —$(CF_2O)_x(CF_2CF_2O)_y(CF_2CF_2CF_2O)_z(CF_2CF_2CF_2CF_2O)_w$—;

x, y, z and w are independently selected from an integer from 0 to 30;

p, and q are independently selected from an integer from 0 to 3;

A and B are independent and have the structure selected from: —$(CH_2CH(OH)CH_2O)_jH$; and j is an integer from 0 to 3.

In some aspects, the polyfluoro lubricant composition comprises one or more compounds of formula I where A is —H (hydrogen). In some aspects, the polyfluoro lubricant composition comprises one or more compounds of formula I where A is —$CH_2CH(OH)CH_2OH$. In some aspects, the polyfluoro lubricant composition comprises one or more compounds of formula I where A is —$CH_2CH(OH)CH_2OCH_2CH(OH)CH_2OH$. In some aspects, A is —$(CH_2CH(OH)CH_2O)_jH$, where j is an integer from 0 to 3. In some aspects, the polyfluoro lubricant composition comprises one or more compounds of formula I where B is —H. In some aspects, the polyfluoro lubricant composition comprises one or more compounds of formula I where B is —$CH_2CH(OH)CH_2OH$. In some aspects, the polyfluoro lubricant composition comprises one or more compounds of formula I where B is —$CH_2CH(OH)CH_2OCH_2CH(OH)CH_2OH$. In some aspects, B is —$(CH_2CH(OH)CH_2O)_gH$, where g is an integer from 0 to 3.

In some aspects, the polyfluoro lubricant composition comprises one or more compounds of formula I where x is selected from 0, 1, 2, 3, 4, 5, 6, 7, 8, 9, 10, 11, 12, 13, 14, 15, 16, 17, 18, 19, 20, 21, 22, 23, 24, 25, 26, 27, 28, 29, and 30. In some aspects, the polyfluoro lubricant composition comprises one or more compounds of formula I where y is selected from 0, 1, 2, 3, 4, 5, 6, 7, 8, 9, 10, 11, 12, 13, 14, 15, 16, 17, 18, 19, 20, 21, 22, 23, 24, 25, 26, 27, 28, 29, and 30. In some aspects, the polyfluoro lubricant composition comprises one or more compounds of formula I where z is selected from 0, 1, 2, 3, 4, 5, 6, 7, 8, 9, 10, 11, 12, 13, 14, 15, 16, 17, 18, 19, 20, 21, 22, 23, 24, 25, 26, 27, 28, 29, and 30. In some aspects, the polyfluoro lubricant composition comprises one or more compounds of formula I where w is selected from 0, 1, 2, 3, 4, 5, 6, 7, 8, 9, 10, 11, 12, 13, 14, 15, 16, 17, 18, 19, 20, 21, 22, 23, 24, 25, 26, 27, 28, 29, and 30.

In some aspects, the polyfluoro lubricant composition comprises one or more compounds of formula I where p is selected from 0, 1, 2, and 3. In some aspects, the polyfluoro lubricant composition comprises one or more compounds of formula I where q is selected from 0, 1, 2, and 3.

In some aspects, $R_1$ has the structure of —$(CF_2O)_x(CF_2CF_2O)_y(CF_2CF_2CF_2O)_z(CF_2CF_2CF_2CF_2O)_w$—. In some aspects, $R_1$ has the structure which can include or exclude:

—$(CF_2O)_x(CF_2CF_2O)_y(CF_2CF_2CF_2O)_z$—;
—$(CF_2O)_x(CF_2CF_2O)_y(CF_2CF_2CF_2CF_2O)_w$—;
—$(CF_2O)_x(CF_2CF_2CF_2O)_z(CF_2CF_2CF_2CF_2O)_w$—;
—$(CF_2CF_2O)_y(CF_2CF_2CF_2O)_z(CF_2CF_2CF_2CF_2O)_w$—;
—$(CF_2CF_2CF_2O)_z(CF_2CF_2CF_2CF_2O)_w$—;
—$(CF_2O)_x(CF_2CF_2CF_2CF_2O)_w$—;
—$(CF_2O)_x(CF_2CF_2O)_y$—;
—$(CF_2CF_2O)_y(CF_2CF_2CF_2CF_2O)_w$—;
—$(CF_2CF_2O)_y(CF_2CF_2CF_2O)_z$—;
—$(CF_2O)_x(CF_2CF_2CF_2O)_z$—;
—$(CF_2CF_2O)_y(CF_2CF_2CF_2O)_z(CF_2CF_2CF_2CF_2O)_w$—;
—$(CF_2O)_x$—;
—$(CF_2CF_2O)_y$—;
—$(CF_2CF_2CF_2O)_z$—; and
—$(CF_2CF_2CF_2CF_2O)_w$—.

In some aspects, $R_2$ has the structure of —$(CF_2O)_x(CF_2CF_2O)_y(CF_2CF_2CF_2O)_z(CF_2CF_2CF_2CF_2O)_w$—. In some aspects, $R_2$ has the structure which can include or exclude:

—$(CF_2O)_x(CF_2CF_2O)_y(CF_2CF_2CF_2O)_z$—;
—$(CF_2O)_x(CF_2CF_2O)_y(CF_2CF_2CF_2CF_2O)_w$—;
—$(CF_2O)_x(CF_2CF_2CF_2O)_z(CF_2CF_2CF_2CF_2O)_w$—;
—$(CF_2CF_2O)_y(CF_2CF_2CF_2O)_z(CF_2CF_2CF_2CF_2O)_w$—;
—$(CF_2CF_2CF_2O)_z(CF_2CF_2CF_2CF_2O)_w$—;
—$(CF_2O)_x(CF_2CF_2CF_2CF_2O)_w$—;
—$(CF_2O)_x(CF_2CF_2O)_y$—;
—$(CF_2CF_2O)_y(CF_2CF_2CF_2CF_2O)_w$—;
—$(CF_2CF_2O)_y(CF_2CF_2CF_2O)_z$—;
—$(CF_2O)_x(CF_2CF_2CF_2O)_z$—;

—$(CF_2CF_2O)_y(CF_2CF_2CF_2O)_z(CF_2CF_2CF_2CF_2O)_w$—;

—$(CF_2O)_x$—;

—$(CF_2CF_2O)_y$—;

—$(CF_2CF_2CF_2O)_z$—; and

—$(CF_2CF_2CF_2CF_2O)_w$—.

In some aspects, the number average molecular weight of the one or more compounds of Formula I is between about 300 Da to about 9000 Da. In some aspects, the number average molecular weight of the one or more compounds of Formula I is between about 1000 Da to about 3000 Da. In some aspects, the number average molecular weight of the one or more compounds of Formula I is between about 900 Da to about 1800 Da. In some aspects, the number average molecular weight of the one or more compounds of Formula I is between about 1100 Da to about 1350 Da.

In some aspects, the polyfluoro lubricant composition further comprises a liquid medium. In some aspects, the liquid medium is a polyfluoroether (PFPE) polymer. The PFPE polymer can include or exclude: Zdol, Z-DIAC, Z-tetraol, A20H, AM2001, X1-P,Z-03 and D-4OH.

In some aspects, this disclosure relates to an apparatus comprising: a substrate; a magnetic layer over the substrate for magnetic recording; a protective overcoat for protecting the magnetic layer; and a layer of lubricant composition as described herein.

In some aspects, this disclosure relates to a method of lubricating a media storage layer surface in an apparatus, the method comprising the step of applying a lubricant composition as described herein over a surface to be lubricated. In some aspects, the relative touchdown spacing of the polyfluoro lubricant composition described herein on a media storage layer is more than 2 Angstroms compared to the touchdown spacing of Z-Tetraol. In some aspects, the total organic adsorption of the polyfluoro lubricant composition described herein on a media storage layer is less than 45 percent of the total organic adsorption of Z-Tetraol.

In some aspects, this disclosure relates to a surface-coated media storage apparatus made by the steps of: (a) providing a substrate, (b) depositing a thin film onto the substrate to create a seed layer, (c) depositing a thin film onto the seed layer to create a magnetic layer, (d) depositing a thin film onto the magnetic layer to create a protective layer, (e) depositing a polyfluoro lubricant composition described herein onto the protective layer.

BRIEF DESCRIPTION OF THE DRAWINGS

The present invention is best understood from the following detailed description when read in conjunction with the accompanying drawing. It is emphasized that, according to common practice, the various features of the drawing are not necessarily to scale. On the contrary, the dimensions of the various features are arbitrarily expanded or reduced for clarity. Like numerals denote like features throughout the specification and drawing.

FIG. 3 provides a representative example of a preparation for the compound of Formula I wherein both terminal moieties are the same, in accordance with some embodiments.

FIG. 4 provides a representative example of a preparation for the compound of Formula I wherein the terminal moieties are different, in accordance with some embodiments.

DETAILED DESCRIPTION

Figure 1:
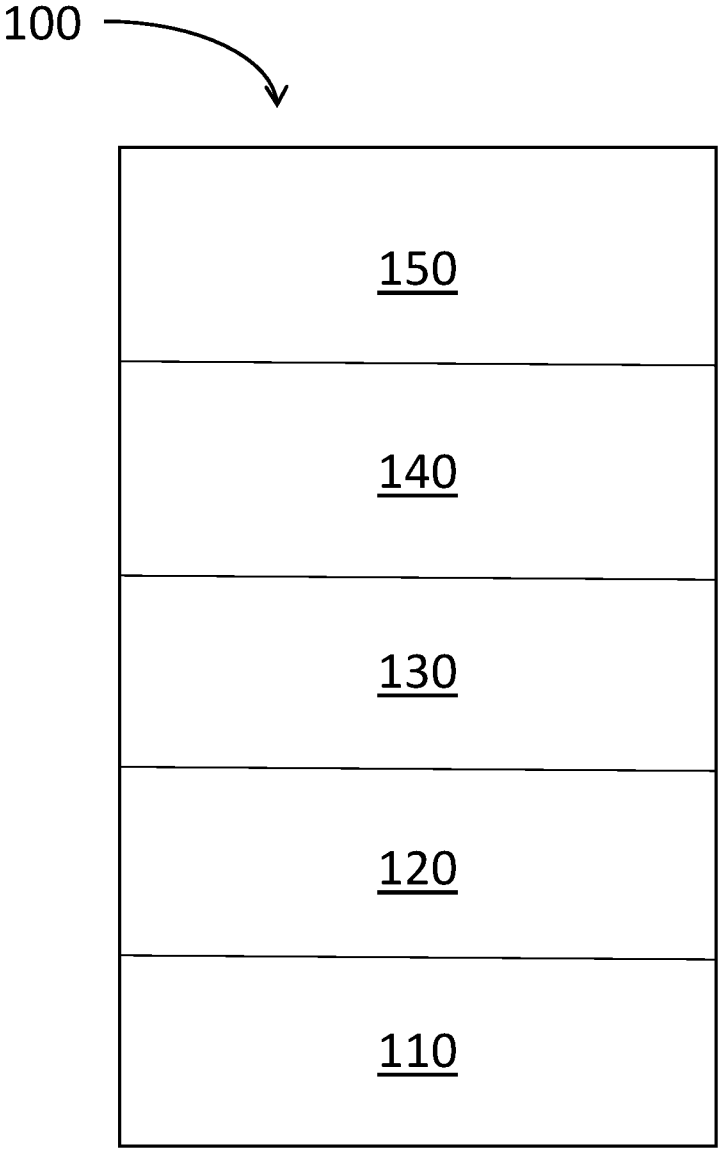
FIG. 1 provides a block diagram of an apparatus for magnetic recording comprising a lubricant layer comprising a composition comprising polyfluoro lubricants in accordance with some embodiments.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

The inventors have surprisingly recognized that polyfluoro lubricant compositions comprising a compound of Formula I can be made by the selective ligation of polyfluoro polymer entities using a glycidyl ether or epichlorohydrin-based linkage chemistry. Without being bound by theory, the hydroxyl functional groups on the polyfluoro polymers of the polyfluoro lubricant composition can form hydrogen bonds to a substrate, which enables the polyfluoro lubricant composition to have a tighter binding strength to the substrate, resulting in lower volatilization of the polyfluoro polymer.

Figure 2:
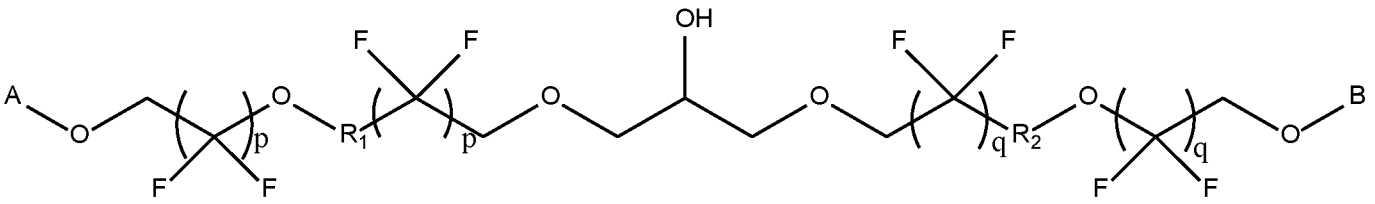
FIG. 2 provides example compounds of Formula I, which may be used as a lubricant or in a lubricant composition in accordance with some embodiments.
Figure 3A:
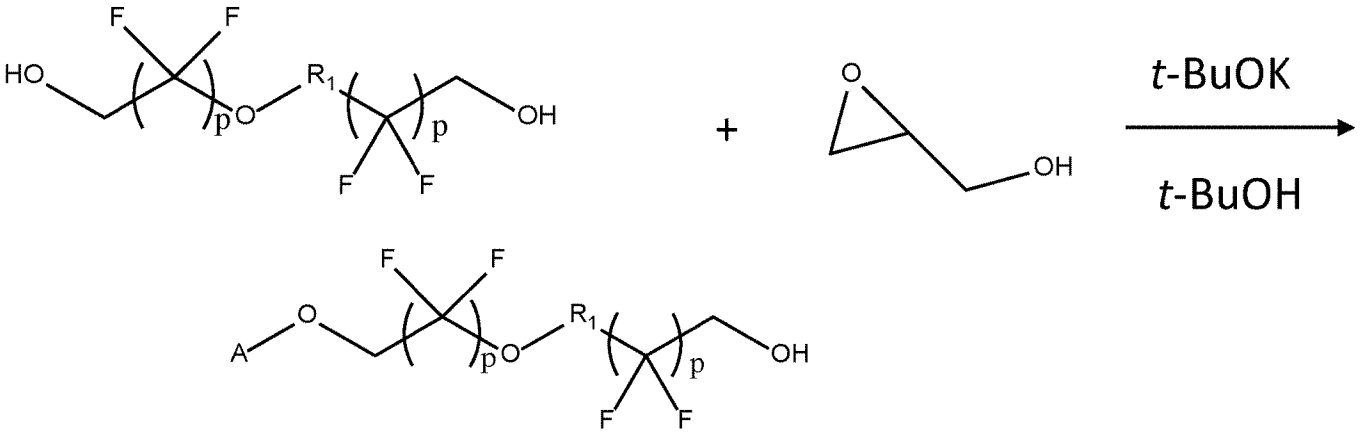
FIG. 3A shows the reaction of the starting material Z-dol with glycidyl ether to form a monofunctionalized polyfluoro polymer, where p is 1, and $R_1$ is $(CF_2O)_x(CF_2CF_2O)_y$.
Figure 3B:
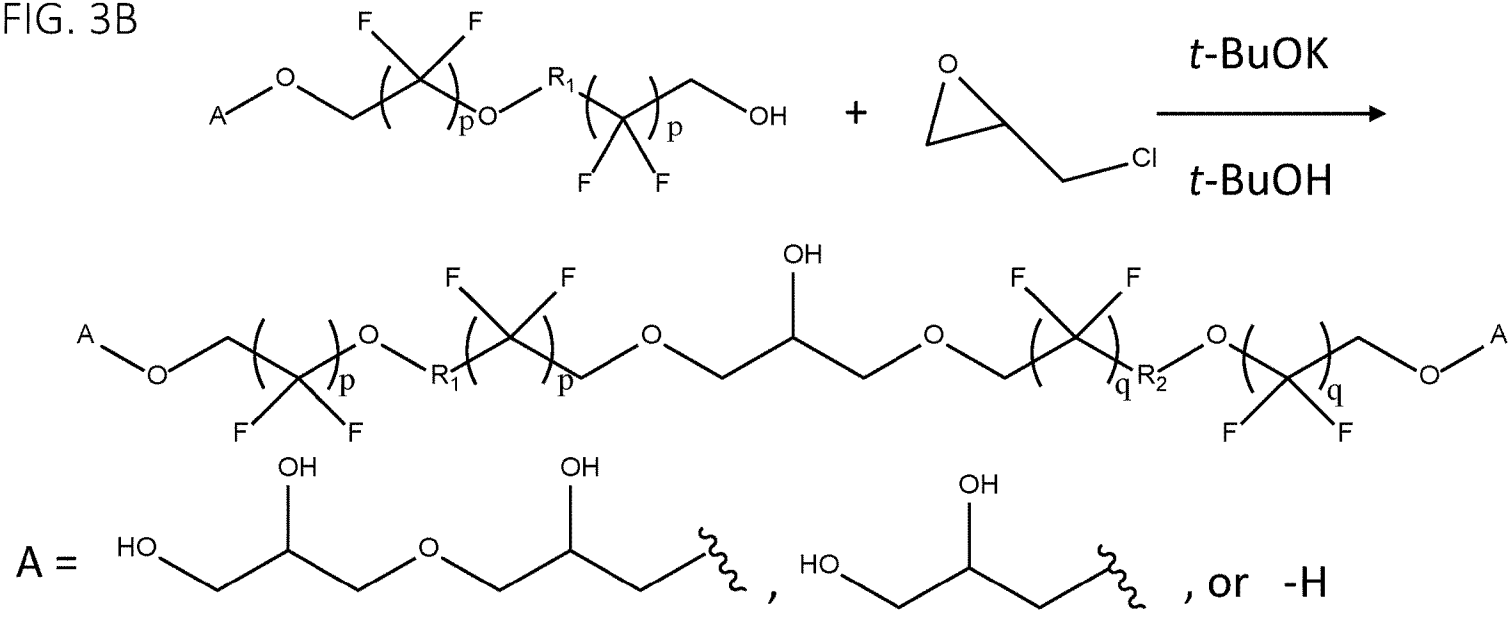
FIG. 3B shows the reaction of two monofunctionalized polyfluoro polymers with epichlorohydryin to form the bis-functionalized polyfluoro polymer.
Figure 4A:
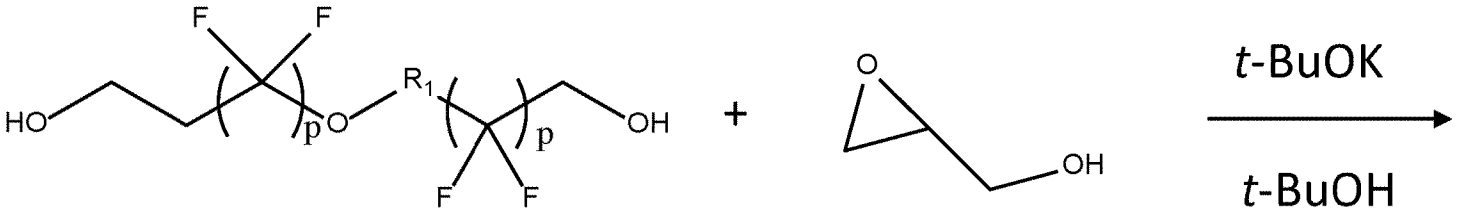
FIG. 4A shows the reaction of the starting material Z-dol with glycidyl ether to form a first monofunctionalized polyfluoro polymer.
Figure 4B:
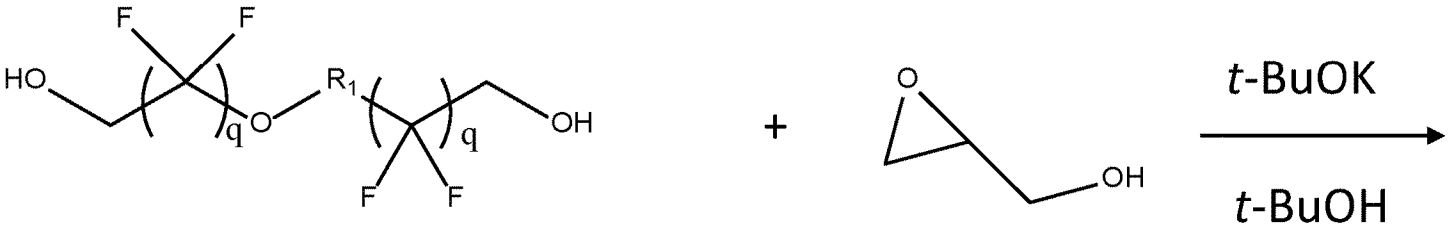
FIG. 4B shows the reaction of the starting material Z-dol with glycidyl ether to form a second monofunctionalized polyfluoro polymer.
Figure 4C:
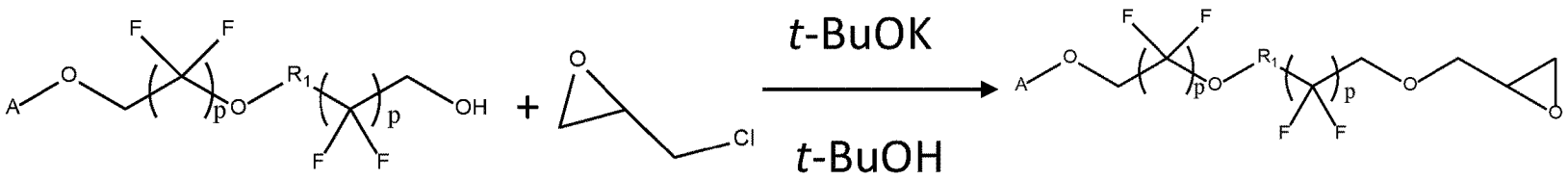
FIG. 4C shows the reaction of the first monofunctionalized polyfluoropolymer with epichlorohydrin to form the first monofunctionalized polyfluoropolymer with epoxide end group.
Figure 4D:
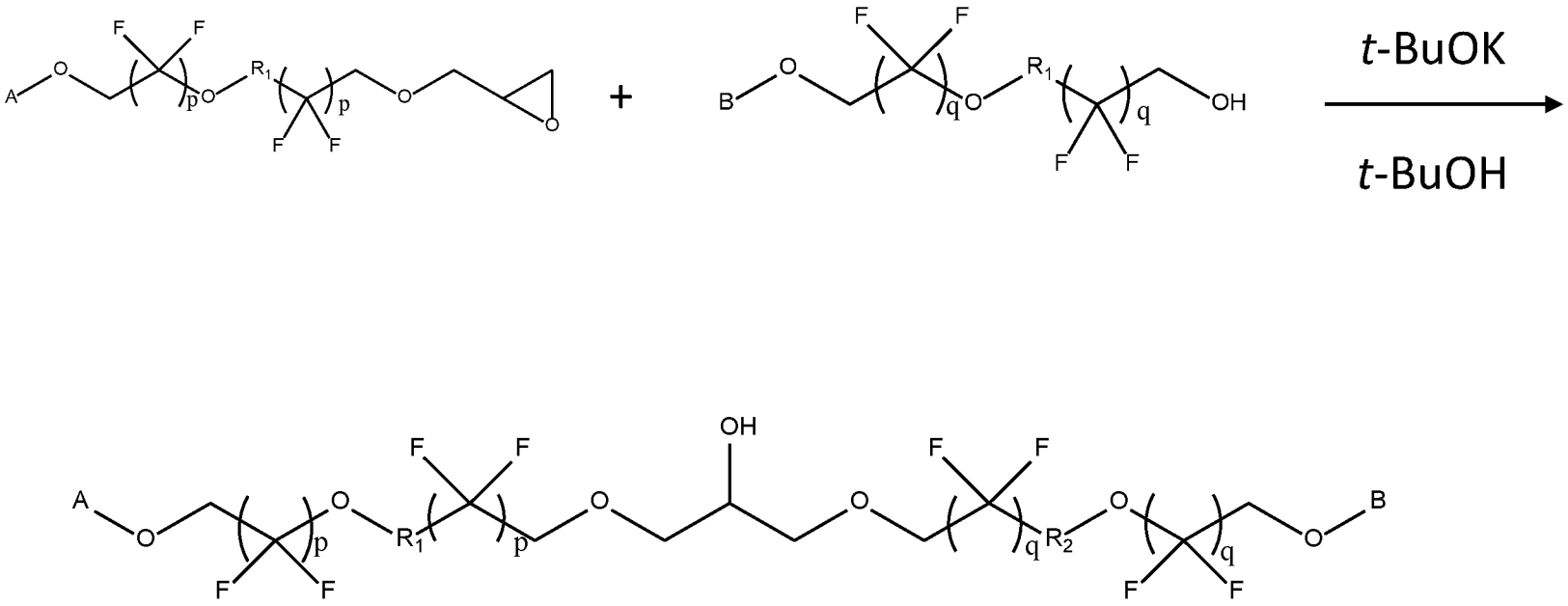
FIG. 4D shows the reaction of the first monofunctionalized polyfluoropolymer with epoxide end group and the second monofunctionalized polyfluoro polymer to form the heterobifunctionalized polyfluoro polymer.

In some embodiments, this disclosure relates to a general synthesis scheme of the following:

HO—X—OH+glycidyl ether→HO—X-glycerol+
HO—X—OH+glycerol-X-glycerol, having the general formula as shown in FIG. 2, wherein X is a polyfluoro polymer comprising those described herein (FIG. 3A and FIG. 3B). The inventors have recognized that the ratio of the products is statistically 2:1:1 (molar) of HO—X-glycerol:HO—X—OH:glycerol-X-glycerol, but the ratio can be altered using a different input ratio of HO—X—OH to glycidyl ether. The inventors have recognized that the HO—X-glycerol product (a first monofunctionalized polyfluoro polymer) from the reaction described above can be further ligated with glycidyl ether to form a polyfluoro polymer with a diglycerol end group. In some embodiments, the HO—X-glycerol product can be reacted with a HO—Y-glycerol product (a second monofunctionalized polyfluoro polymer) in the presence of, or first reacted with, epichlorohydrin to form asymmetric glycerol-X-glycerol-Y-glycerol, glycerol-X-glycerol-Y—OH, and HO—X-glycerol-Y-glycerol products, where Y is a polyfluoro polymer comprising those described herein and different from X (FIG. 4A, FIG. 4B, FIG. 4C, and FIG. 4D). In some embodiments, the reaction of first monofunctionalized polyfluoro polymer can proceed with epichlorohydrin first, resulting in a first monofunctionalized polyfluoro polymer with epoxide endgroup (FIG. 4C). The first monofunctionalized polyfluoro polymer with epoxide endgroup can be subsequently reacted with the second monofunctionalized polyfluoro polymer to form the heterobifunctional polyfluoropolymer (FIG. 4D). The reaction schemes can be further formulated by reacting with a series of glycidol ether compounds to form a poly-glycerol moiety within the polyfluoro polymer.

Process of Forming Polyfluoro Compounds

The process of forming polyfluoro compounds comprising a homo-bifunctional polyfluoro compound of the present disclosure can involve two steps:

Step 1: The fluoropolyether having hydroxyl (e.g. Z-dol) at both ends can be reacted with glycidol in a solvent (e.g. t-Butanol) in the presence of a catalyst (potassium t-butoxide) at an elevated temperature. In some embodiments, the elevated temperature is in the range of 40-80° C. In some embodiments, the elevated temperature is 65° C. After 24 hours, the reaction mixture can be neutralized by acid (including 1 M HCl) and washed with 10% isopropanol in water and then dried by rotary evaporation. The mixture can be separated by vacuum distillation, column chromatography or supercritical fluid extraction (SFE). In some embodiments, the mixture can be separated by supercritical fluid extraction. Different fractions with the structure shown in FIG. 3A can be produced and used for further reactions.

Step 2: The product perfluoro polymer with one hydroxyl at one terminal and one group A at the opposite terminal end from step 1 can be reacted with epichlorohydrin in a solvent (e.g. t-butanol) in the presence base (e.g. potassium t-butoxide) at elevated temperature in the range of 40-80° C. In some embodiments, the elevated temperature is 65° C. After 72 hrs, the reaction mixture can be neutralized by acid (including 1 M HCl) and washed 10% isopropanol in water and dried by rotary evaporation. The mixture can be separated by vacuum distillation, column chromatography or supercritical fluid extraction (SFE). The final product with the structure shown in FIG. 3B is produced.

The process of forming polyfluoro compounds comprising a heterobifunctional polyfluoro compound of the present disclosure can involve four steps:

Step 1: The polyfluoro compounds having hydroxyl (eg. Z-dol) at both ends can react with glycidol in a solvent (e.g. t-butanol) in the presence of catalyst (potassium t-butoxide) at a temperature range of 40-80° C. (65° C. is preferred). After 24 hours, the reaction mixture can be neutralized by acid (including 1 M HCl) and washed with 10% isopropanol in water and dried by rotary evaporation. The mixture can be separated by vacuum distillation, column chromatography or supercritical fluid extraction (SFE). Different fractions with the structure shown in FIG. 4A can be collected and used for further reactions.

Step 2: The polyfluoro compounds having hydroxyl (e.g. FPEG) at both ends can react with glycidol in a solvent (e.g. t-butanol) in the presence of catalyst (potassium t-butoxide) at a temperature ranging from 40-80° C. (65° C. is preferred). After 24 hours, the reaction mixture can be neutralized by acid (including 1 M HCl) and washed with 10% isopropanol in water then dried by rotary evaporation. The mixture can be separated by vacuum distillation, column chromatography or supercritical fluid extraction (SFE). Different fractions with the structure shown in FIG. 2B can be collected and used for further reactions.

Step 3: The product polyfluoro compounds with one hydroxyl at one terminal and one group A at the opposite terminal from step 1 can be reacted with epichiorohydrin in a solvent (e.g. t-butanol) in the presence base (e.g. potassium t-butoxide) at temperature ranging from 40-80° C. (65° C. is preferred). After 48 hrs, the reaction mixture can be neutralized by acid (including 1 M HCl) and washed with 10% isopropanol in water then dried by rotary evaporation. The mixture can be separated by vacuum distillation, column chromatography or supercritical fluid extraction (SFE). The final product with the structure shown in FIG. 4C can be collected and used for further reactions.

Step 4: The product from step 2 and base (0.1 eq, potassium t-butoxide) can be dissolved into a solvent (e.g. t-butanol) at elevated temperature ranging from 40-80° C. (65° C. is preferred). After 1 hr, the product from step 3 (1 eq) can be added into the reaction. After 48 hrs, the reaction mixture can be neutralized by acid (including 1 M HCl) and washed with 10% isopropanol in water then dried by rotary evaporation. The mixture can be separated by vacuum distillation, column chromatography or supercritical fluid extraction (SFE). The final product with the formula shown in FIG. 4D is produced.

Definitions

As used in this application, the following words or phrases include the meanings specified.

A "storage medium" (plural: "storage media") or "recording medium" (plural: "recording media") includes any apparatus that can store information including digital data. The storage medium may be in the form of a thin magnetic film, for example, a magnetic film of cobalt, platinum, and/or chromium alloy over a supporting substrate. A supporting substrate can include a nickel-phosphorous-plated aluminum or glass disk. The storage medium may also have a protective layer or overcoat applied over the magnetic film. A protective overcoat can include amorphous carbon such as diamond-like carbon.

A "recording layer" or "recording surface" includes a portion of a storage medium adapted for magnetic recording of information. The magnetic recording can be effected by a magnetic head (or read-write head) assembly flying over the recording layer or recording surface. The magnetic head assembly can be mounted on a slider with an air-bearing surface for flying over the recording surface.

As used herein, a "polyfluoro polymer" includes a compound or polymer composed of at least some fluoroalkyloxy units (e.g., —$CH_2CF_2$—, —$CF_2CH_2O$—, —$CH_2CH_2CF_2O$—, —$CH_2CF_2CF_2O$—, —$CH_2CF_2CH_2O$—, —$CF_2CF_2CH_2O$—, —$CF_2CH_2CH_2O$—, —$CF_2CH_2CF_2$—, —$CF_2CF_2CF_2CF_2O$—, —$CF_2CF_2CF_2O$— etc.), some of which may optionally be polyfluoroalkyloxy units (e.g., —$CF_2CF_2O$—, —$CF_2CF_2CF_2O$—, etc.). A "polyfluoropolyether" ("PFPE") includes a compound or polymer composed of polyfluoroalkyloxy units. Polyfluoropolyethers can include or exclude Fomblin Z (random copolymer of $CF_2CF_2O$ and $CF_2O$ units), Fomblin Y (random copolymer of $CF(CF_3)CF_2O$ and $CF_2O$), and functional derivatives of Fomblin Z or Fomblin Y such as ZDOL, Z-DIAC, ZDOL TX, and Z-TETRAOL, available from Montedison S.p.A (Milan, Italy); Demnum™, available from Daikin America, Inc. (Orangeburg, N.Y.); DuPont™ Krytox®; UniFlor 8512, 8172, 8182, 8192, 8511, 8521, 8531, 8612, 8322, 8711, 8731, 8751, 8771, 8951, 8961, 8971, 8921, 8981, 8931; Rocol OT20, UT18, RT15, YVAC3, YNX; and SlipKote PF-30, PF-29, and PF-27.

Various aspects of polyfluoro lubricant compositions comprising one or more polymers having the structure of formula I including compositions for storage media and storage media incorporating the polyfluoro lubricant compositions are provided herein below. However, as those of ordinary skill in the art will readily appreciate, the polyfluoro lubricant compositions may be used in other capacities including other compositions and apparatuses.

Various aspects of lubricant compositions comprising polyfluoro lubricant compositions for storage media and storage media incorporating the polyfluoro lubricant compositions are provided herein below. However, as those of ordinary skill in the art will readily appreciate, the polyfluoro lubricant compositions may be used in other capacities including other compositions and apparatuses.

Polyfluoro Lubricant Compositions

Polyfluoro lubricant compositions can comprise one or more polyfluoro polymers comprising a compound of formula I. Without being bound by theory, the hydroxyl functional groups of the A and B moieties can hydrogen bond to a surface (e.g., diamond-like carbon-coated surface) over which the polyfluoro lubricant composition is applied. The surface bonding draws and conforms the polyfluoro polymer to the surface. In addition to optimizing bonding of polyfluoro polymers to surfaces such as those with a carbon (e.g., diamond-like carbon) overcoat, the use of the hydroxyl functional groups in the foregoing configuration beneficially reduces the height that lubricants including the polyfluoro polymers can reach into head-media spacing ("HMS") in hard disk drives.

Polyfluoro lubricants can comprise one or more compounds of Formula I:

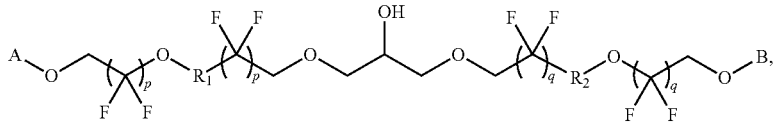

wherein $R_1$ and $R_2$ are independent and have the structure selected from —$(CF_2O)_x(CF_2CF_2O)_y(CF_2CF_2CF_2O)_z(CF_2CF_2CF_2CF_2O)_w$—;

x, y, z and w are independently selected from an integer from 0 to 30;

p, and q are independently selected from an integer from 0 to 3;

A and B are independent and have the structure selected from: —$(CH_2CH(OH)CH_2O)_jH$; and j is an integer from 0 to 3.

For polyfluoro lubricants comprising one or more compounds of Formula I, the values of p, q, w, x, y, z, and j, each of which may be greater than or equal to 1 (e.g., 1, 2, 3, 4, 5, etc.), may be selected so as to provide compounds having a molecular weight that falls within a desired average range. The number average molecular weight range, for example, may range from about 1000 dalton ("Da") to about 7000 Da, including from about 1000 Da to about 5000 Da, such as about 1300 Da to about 4000 Da.

Compared to other lubricants (e.g., Z-dol, Z-tetraol from Solvay, D-4OH from Moresco), polyfluoro lubricants comprising the polyfluoro polymers of Formula I provide higher resistance to head-media contact (e.g., higher power is needed during a shock event to put the head into contact with underlying media); lower lubricant pickup by head (e.g., the low-flying or media-contacting head picks up less lubricant); lower negative burnish; and lower HMS, which, in turn, leads to higher areal density.

In some embodiments, the polyfluoro composition can further comprise a species which can include or exclude an anti-oxidant, internal pressure preventing agent, anti-abrasive agent, viscosity index improver, or anti-static agent.

Apparatuses Incorporating the Lubricant, and Methods for Lubricating

Apparatuses such as storage media comprise a polyfluoro lubricant layer formed from polyfluoro lubricant compositions comprising one or more compounds of formula I are provided. Methods for lubricating apparatuses such as storage media may comprise lubricating with polyfluoro compositions comprising one or more polyfluoro compounds of formula I.

With respect to the apparatuses, FIG. 1 provides an illustration showing the layers of a storage medium comprise a substrate 110, a seed layer 120, a magnetic layer 130, a protective layer 140, and a polyfluoro lubricant layer 150. The initial layer of the media structure is the substrate 110, which may be a nickel-phosphorous-plated aluminum or glass disk. The seed layer 120 may be a thin film deposited onto the substrate 110, which thin film may be chromium. The magnetic layer 130 may be a thin film deposited on top of the seed layer 120, which thin film may be a magnetic alloy which can include or exclude cobalt (Co), platinum (Pt), and/or chromium (Cr) alloy. The magnetic layer may be applied at a thickness of about 500 Å over the substrate.

The protective layer 140 is a thin film deposited on top of the magnetic layer 130. The protective layer 140 may be a diamond-like carbon ("DLC") layer, which exhibits properties between those of graphite and diamond. The DLC layer may be deposited using thin film deposition techniques such as one or more thin film deposition techniques selected from ion beam deposition (IBD), plasma enhanced chemical vapor deposition (PECVD), magnetron sputtering, radio frequency sputtering, and chemical vapor deposition (CVD). During the deposition process, adjusting sputtering gas mixtures of argon and hydrogen varies the concentrations of hydrogen found in the DLC. The protective layer may be about 150 Å thick, or the protective layer may be less than 150 Å thick, such as less than 100 Å thick.

Lubricant layer 150 comprising one or more compounds of Formula I may be deposited on top of the protective layer 140 for added protection, lubrication, and enhanced disk drive reliability. Polyfluoro lubricant layer 150 reduces wear and damage caused by occasional contacts of the magnetic head assembly with the storage medium.

The durability and reliability of storage media is achieved primarily by the application of the protective layer 140 and the polyfluoro lubricant layer 150. As the thickness of the protective layer 140 and the polyfluoro lubricant layer 150 is reduced, greater integration at the interface of the protective layer 140 and the polyfluoro lubricant layer 150 is specified to provide a more durable protective film. The conformation of the lubricant molecules on the protective layer 140 is also of importance to the HMS. In addition, lubricants comprising one or more compounds of Formula I with multi-point attachments to the protective layer 140 are better able to cover the entire surface of the protective layer 140 than compounds with only end-point attachments.

Methods of Using Polyfluoro Lubricant Compositions Disclosed Herein

The polyfluoro lubricant composition of the present disclosure is applied onto a substrate, or the liquid composition containing the polyfluoro lubricant composition of the present disclosure is applied onto a substrate and dried (i.e. the liquid medium is removed from the liquid composition) to form a film (surface layer) containing the polyfluoro polymer of the present disclosure, therein to let the desired function be exhibited, including providing a polyfluoro lubricant layer. The polyfluoro lubricant layer may be formed using a polyfluoro lubricant comprising one or more compounds of Formula I.

In some embodiments, the substrate is a magnetic disk.

The method for applying the polyfluoro lubricant composition of the present disclosure can include or exclude a roll coating method, a casting method, a dip coating method, a spin coating method, a water casting method, a die coating method, a Langmuir-Blodgett method, a vacuum deposition method, a spin coating method, a dip coating method, or a vacuum deposition method.

When the polyfluoro lubricant composition of the present disclosure is a liquid composition applied to a substrate, the drying method can include or exclude natural drying, vacuum drying, centrifugal drying, or heat drying.

In some embodiments, after forming the surface layer containing the polyfluoro lubricant composition of the present disclosure on a substrate, adhesion treatment may be carried out in order to firmly adhere the polyfluoro lubricant composition of the present disclosure on the substrate (for example, on the carbon protective film of the magnetic disk).

In some embodiments, the adhesion treatment can include or exclude heat treatment, infrared irradiation treatment, ultraviolet irradiation treatment, plasma treatment, or drying treatment.

In some embodiments, the method of applying the polyfluoro lubricant composition can include a washing step to the substrate after adhesion treatment. The washing step can include or exclude a fluorinated organic solvent for the purpose of removal of deposits or removal of an excess polyfluoro polymer compounds.

The polyfluoro lubricant layer such as lubricant layer 150 may be applied evenly in a thin film having a thickness from about 5 Å to about 50 Å, including from about 8 Å to about 40 Å, for example, from about 10 Å to about 20 Å. The polyfluoro lubricant layer may be made as thin as possible while maintaining its characteristics related to storage media durability and slider flyability. The selection of the thickness of the polyfluoro lubricant layer may depend on interactions between the storage medium and the magnetic head assembly, which interactions include the static friction or "stiction" force on the slider, air shear, and/or the tendency of the lubricant to evaporate.

The methods of preparing storage media using the polyfluoro lubricant compositions described herein may be incorporated into methods for manufacturing disks and disk drives. In accordance with these methods, more durable, higher-density storage media may be provided.

GPC Analysis

The number average molecular weight (Mn) and the molecular weight distribution (Mw/Mn) (also referred to herein as "polydispersity", or "PDI") can be measured by gel permeation chromatography (GPC). As used herein, Mw indicates the mass average molecular weight.

The weight average molecular weight (Mw) of the synthesized perfluoro polymer can be measured by Gel Permeation Chromatography (GPC). In some embodiments, the GPC can be performed using a using Waters ACQUITY Advanced Polymer Chromatography System with Waters ACQUITY Evaporative Light Scattering Detector (ELSD). In some embodiments, the GPC process includes a mobile phase of mixed solvent. In some embodiments, the mobile phase is a mixed solvent of THF (HPLC grade, ≥99.9%, inhibitor-free, Sigma-Aldrich Inc.) and Vertrel (Chemours) with volume ratio: THF:Vertrel=85:15. In some embodiments, the GPC process includes one or a plurality of analytical columns in series. In some embodiments, the GPC process is performed using two analytical column ACQUITY APC XT 45 in series to achieve the desired molecular weight separation. The Mw of the synthesized perfluoro polymers of this disclosure can be calibrated relative to a polymer molecular weight standard. In some embodiments, the polymer molecular weight standard is polymer made from a living polymerization mechanism. In some embodiments, the polymer molecular weight standard is polystyrene. In some embodiments, the polystyrene standards have Mw's of 1370, 2940 and 4910 g/mol, with PDI (polydispersity index) of less than 1.05. In some embodiments, the mobile phase flow rate can vary between 0.1 to 5.0 mL/min. In some embodiments, the flow rate of the mobile phase is 0.8 mL/min. In some embodiments, the GPC is performed with a column temperature from 40° C. to 70° C. In some embodiments, the column temperature is 50° C. In some embodiments, the GPC is performed with a ELSD drift tube temperature of 50° C. to 70° C. In some embodiments, the ELSD drift tube temperature is 60° C.

In some embodiments, the polyfluoro compounds described herein can be purified by supercritical fluid extraction. In some embodiments, the supercritical fluid extraction can be performed using a PFPE Preparative SFE System (Jasco) or Bio-Botanical Extraction Systems E (Waters, Inc.), using—carbon dioxide alone or carbon dioxide mixed with ethanol or methanol as solvent

EXAMPLES

Compounds of Formula I such as the compounds of FIG. 2 may be prepared by methods provided herein including the methods shown in FIG. 3 and FIG. 4. Those of ordinary skill in the art will appreciate the methods shown in FIG. 3 and FIG. 4 may be used to prepare a number of different compounds of Formula I other than those shown in FIGS. 3 and 4. The number of different compounds of Formula I may be prepared by substitution of one or more starting materials, reagents, and/or conditions with alternatives to those shown in FIG. 3 or FIG. 4 or provided in reference thereto, which may require some additional steps available to those of skill in the art. Those of ordinary skill in the art will also appreciate the compounds of formula I may also be prepared by different methods including different starting materials, reagents, and/or conditions, which methods are available to those of ordinary skill in the art.

Starting materials may be available from commercial sources such as Sigma-Aldrich Co. (St. Louis, Mo.). Starting materials may also be prepared using methods available to those of ordinary skill in the art. For example, some starting materials may be prepared using methods available in the following reference: Ho, T.-L. Fieser and Fieser's Reagents for Organic Synthesis, Vol. 27; John Wiley & Sons: New York, 2013.

Organic transformations such as functional group transformations may be used to prepare compounds of Formula I. For example, some organic transformations may be used in accordance with organic transformations available in the following reference: Larock, R. C. Comprehensive Organic Transformations, A Guide to Functional Group Preparations, 2nd ed.; John Wiley & Sons: New York, 1999.

GPC Characterization of perfluoro polymer. The weight average molecular weight (Mw) of the synthesized perfluoro polymer was measured by GPC using Waters ACQUITY Advanced Polymer Chromatography System with Waters ACQUITY Evaporative Light Scattering Detector (ELSD). The mobile phase was a mixed solvent of THF (HPLC grade, ≥99.9%, inhibitor-free, Sigma-Aldrich Inc.) and Vertrel (Chemours) with volume ratio: THF:Vertrel=85:15. Two analytical column ACQUITY APC XT 45 are used in series to achieve desired molecular weight separation. The Mw of synthesized perfluoro polymer is calibrated relative to polystyrene. The polystyrene standards used have Mw's of 1370, 2940 and 4910 g/mol, with PDI (polydispersity index) of less than 1.05. The flow rate of the mobile phase is 0.8 mL/min. Column temperature is 50° C., and the temperature of the drift tube in ELSD is 60° C.

Example 1

To a 250 mL flask was added 100 g, (0.076 mol) of FPTMEG ($HOCH_2CF_2CF_2CF_2(OCF_2CF_2CF_2CF_2)_xCF_2CF_2CF_2CH_2OH$, x is an integer ranging from 0 to 20; Mw~1300), potassium t-butoxide (0.86 g, 0.008 mol), and 100 g t-butanol, and the solution warmed to 65° C. The reaction was carried out for 30 minutes, after which, glycidol (5.7 g, 0.0769 mol) was added into the solution. After 24 hrs, the reaction was stopped. The reaction mixture was subsequently washed with a mixture of 90 mL of deionized ("DI") water, 10 mL of isopropyl alcohol, and 1.5 mL of 1:1 HCl. The mixture was then washed with 100 mL of DI water twice. The reaction product was recovered by rotary evaporation. After completely dried by air blowing, the mixture was separated by SFE. The component with structure (a) was collected.

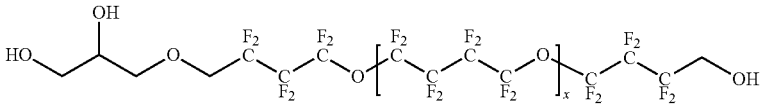

Structure (a) where x is an Integer Ranging from 0 to 20

To a 250 mL flask was added 100 g (0.068 mol) of polyfluoro polymer with structure (a) (Mw~1374), potassium t-butoxide (3.79 g, 0.034 mol), and 100 g t-butanol. The solution was warmed to 65° C. After 30 minutes, epicholorohydrin (2.81 g, 0.030 mol) was added dropwise into the solution. After three days, the reaction was stopped. The reaction mixture was subsequently washed with a mixture of 10 mL of 1M HCl, 10 mL of isopropyl alcohol and 80 ml DI water. The mixture was then washed with 100 mL of DI water twice. The reaction product was recovered by rotary evaporation. After completely dried by air blowing, the mixture was separated by SFE. The component with structure (b) was collected and used alone or as a component in a lubricant composition.

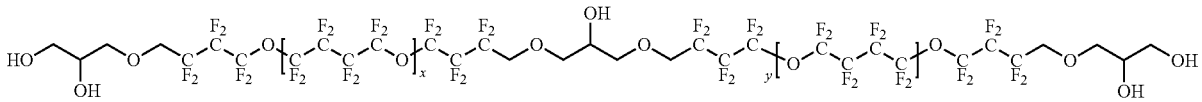

Structure (b) where x, y are an Integer Ranging from 0 to 20

Analytical data for polyfluoro polymer of structure (b):

$^{19}F$ NMR (Solvent: acetone-d6): δ=−84.1 ppm (18F, —OCF2CF2CF2CF2O—, —OCF2CF2CF2OCH2CH2CHCH2OH), δ=−120.97 ppm (8F, —OCF2CF2CF2CH2OCH2CHOHCH2OH, —OCF2CF2CF2CH2OCH2CHOHCH HCH2CF2CF2CF2O—), δ=−126.59 ppm (10F, —OCF2CF2CF2CF2O—), δ=−127.68 ppm (8F, —OCF2CF2CF2CH2OCH2CHCHOHCH2OH, —OCF2CF2CF2CH2OCH2CHOHCHHCH2CF2CF2CF2O—).

MS-TOF: (M+NH4+): 1194.14, 1410.12, 1626.10, 1824.08, 2058.06.

GPC: 1725 g/mol with polystyrene as reference. Polydispersity index=1.01.

Example 2

To a 250 mL flask was added 100 g, (0.1 mol) of D-2OH ($(HOCH_2CF_2CF_2(OCF_2CF_2CF_2)_xOCF_2CF_2CH_2OH$, x is an integer ranging from 0 to 20; Mw~1000), potassium t-butoxide (1.12 g, 0.01 mol), and 100 g t-Butanol. The solution was warmed to 65° C. After 30 minutes, glycidol (7.4 g, 0.1 mol) was added into the solution. After 24 hrs, the reaction was stopped. The reaction mixture was subsequently washed with a mixture of 10 mL of 1M HCl, 10 mL of isopropyl alcohol and 80 ml DI water. The mixture was then washed with 100 mL of DI water twice. The reaction product was recovered by rotary evaporation. After completely dried by air blowing, the mixture was separated by SFE. The component with structure (c) was collected.

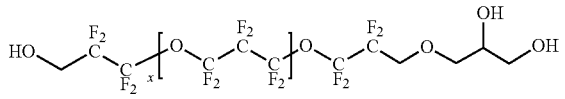

Structure (c) where x is an Integer Ranging from 0 to 20

To a 250 mL flask was added 100 g (0.931 mol) of polyfluoro polymer with structure (c) (Mw~1074), potassium t-butoxide (5.23 g, 0.047 mol), and 100 g t-Butanol. The solution was warmed to 65° C. After 30 minutes, epicholorohydrin (3.88 g, 0.041 mol) was added dropwise into the solution. After three days, the reaction was stopped.

The reaction mixture was subsequently washed with a mixture of 10 mL of 1M HCl, 10 mL of isopropyl alcohol and 80 ml DI water. The mixture was then washed with 100 mL of DI water twice. The reaction product was recovered by rotary evaporation. After completely dried by air blowing, the mixture was separated by SFE. The component with structure (d) was collected and used alone or as a component in a lubricant composition.

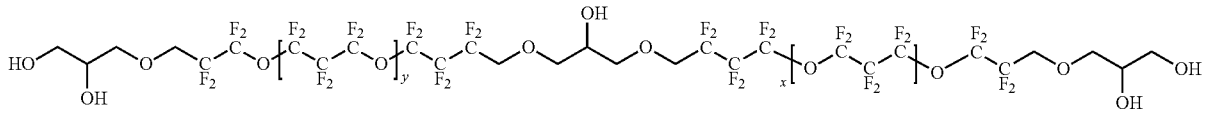

Structure (d) where x, y are Integers from 0 to 20

Example 3

To a 250 mL flask was added 100 g (0.073 mol) of polyfluoro polymer with structure (a) (Mw~1374 g/mol), potassium t-butoxide (8.17 g, 0.073 mol), and 100 g of t-Butanol. After 1 hr, epicholorohydrin (13.47 g, 0.14 mol) was added dropwise into the solution. After 24 hrs, the reaction was stopped. The reaction mixture was subsequently washed with a mixture of 10 mL of 1M HCl, 10 mL of isopropyl alcohol and 80 ml DI water. The mixture was then washed with 100 mL of DI water twice. The reaction product was recovered by rotary evaporation. After completely dried by air blowing, the mixture was separated by SFE. The component with structure (e) was collected

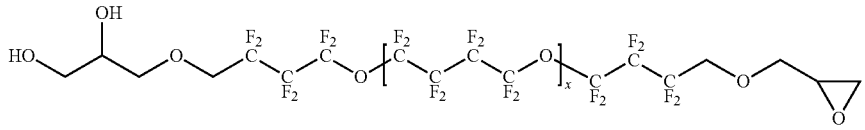

Structure (e) where x are Integers from 0 to 20

To a 250 mL flask was added 100 g (0.0931 mol) polyfluoro polymer with structure (c) (Mw~1074), potassium t-butoxide (10.45 g, 0.0931 mol), and 100 g t-Butanol. The solution was then warmed to 65° C. After 1 hr, the polyfluoro polymer with structure (e) (Mw~1440 g/mol, 134 g, 0.0931 mol) was added. After 48 hrs, the reaction was stopped. The reaction mixture was subsequently washed with a mixture of 10 mL of 1M HCl, 10 mL of isopropyl alcohol and 80 ml DI water. The mixture was then washed with 100 mL of DI water twice. The reaction product was recovered by rotary evaporation. After completely dried by air blowing, the mixture was separated by SFE. The component with structure (f) was collected and used alone or as a component in a lubricant composition.

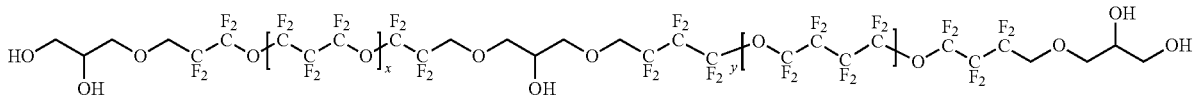

Structure (e) where x, y are Integer 0 to 20

Example 4—Clearance Capability of Lubricated Storage Media

Figure 5:
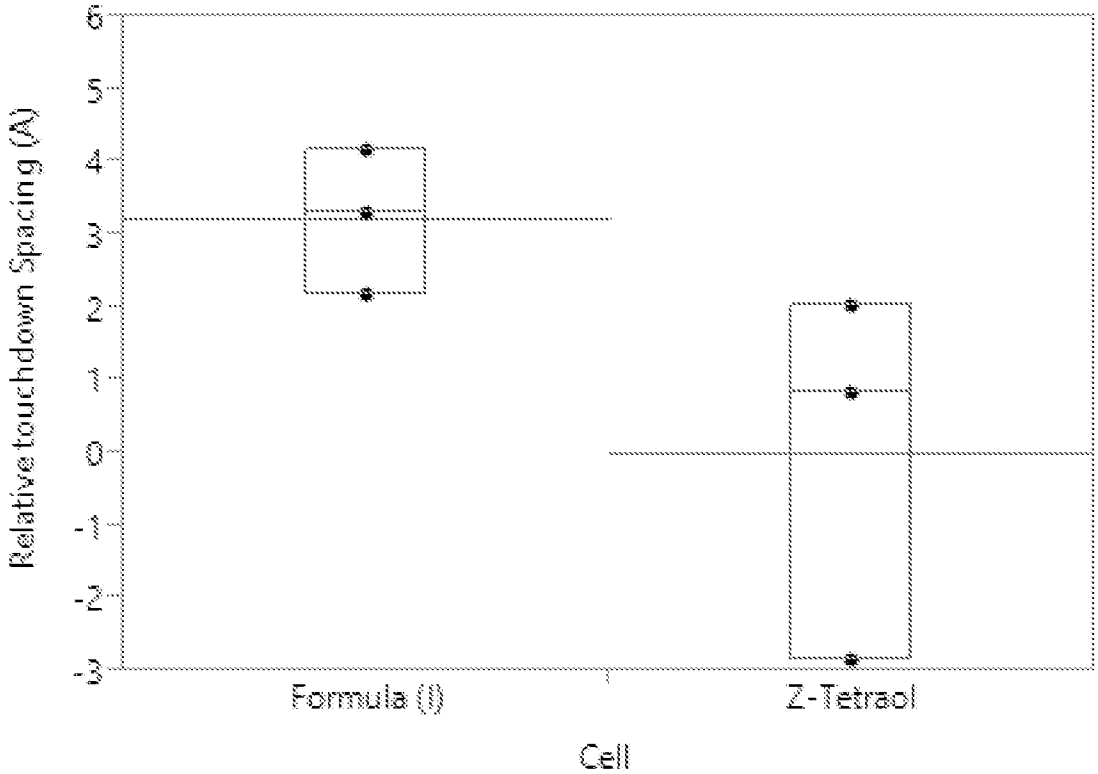
FIG. 5 is a box plot comparing relative touchdown spacing for a flying head above a surface with a conventional lubricant Z-tetraol layer and a surface with a polyfluoro lubricant layer composition comprising a compound of Formula I in accordance with some embodiments.

FIG. 5 is a box plot comparing relative touchdown spacing for a flying head above a surface with a lubricant layer consisting of a conventional lubricant (e.g., Z-Tetraol) and a surface with a lubricant layer including a compound selected from Formula I (e.g., compound of FIG. 2). Touchdown spacing may be described as the distance between the lowest point of the flying head and the top of the lubricant surface. The touchdown spacing of a storage medium using a lubricant including a compound such as that of Formula I may result in more distance between the head and lubricant surface for a given HMS, reducing head-disc interactions and promoting disk drive reliability. Touchdown spacing such as that in FIG. 5 may be measured using an adaptive fly height head to protrude the close point of the head (keeping the flying height constant) until it touches the top of the lubricant layer, with contact determined by an increase in the acoustical emission signal from a sensor on the head. The same head may be used to measure different lubricants, which keeps the flying height constant and allows measurement of the difference in clearance between the lubricants. The conventional lubricant may be arbitrarily set to zero to show the measured difference in clearance from the lubricant.

Example 5—TOC Pick-Up of Lubricants

Figure 6:
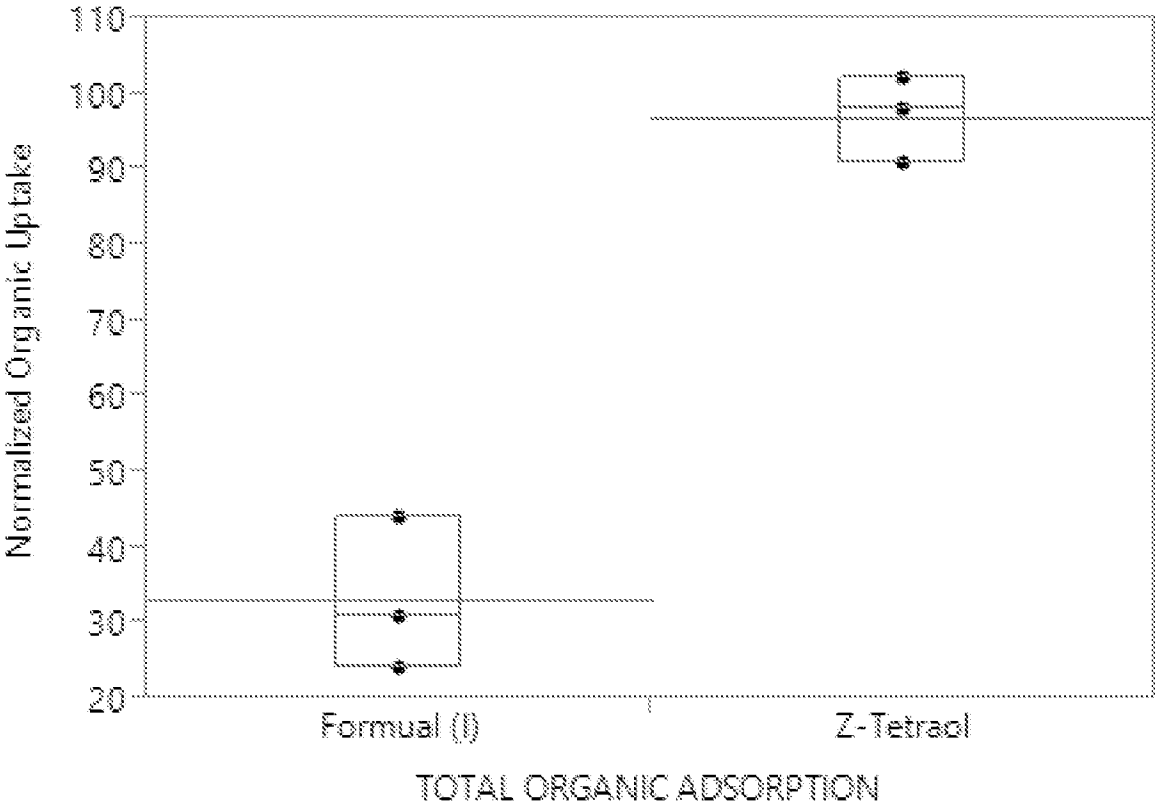
FIG. 6 is a graph comparing putative total organic contamination ("TOC") pick-up for a conventional lubricant Z-tetraol, and a polyfluoro lubricant composition comprising a compound of Formula I in accordance with some embodiments.

FIG. 6 is a graph comparing putative TOC pick-up or total organic adsorption for a conventional lubricant (e.g., Z-Tetraol) and a lubricant including a compound selected from Formula I. Organic contaminants such as hydrocarbons may compromise head-storage media interface reliability by adsorption onto the storage media surface and subsequent accumulation onto the read-write head. One function of a lubricant is to provide an inert barrier film to block adsorption of any contaminants that might be present in the disk drive (e.g., due to outgassing from other drive internal components). Data such as that in FIG. 6 may be collected by exposing media coated with different lubricants to model organic contaminants at elevated temperature in a closed system, followed by extraction and quantification of the amount adsorbed. Lubricants including one or more compounds such as that of Formula I may show a significant reduction in the level of adsorbed contamination as compared to the conventional lubricant.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention. The implementations described above and other implementations are within the scope of the following claims.

What is claimed is:

1. A lubricant composition comprising one or more compounds of Formula I:

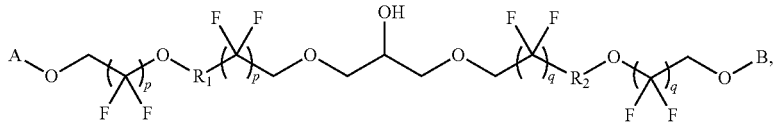

wherein $R_1$ and $R_2$ are independent and have the structure selected from —$(CF_2O)_x(CF_2CF_2O)_y(CF_2CF_2CF_2O)_z(CF_2CF_2CF_2CF_2O)_w$—;

x, y, z and w are independently selected from an integer from 0 to 30;

p, and q are independently selected from an integer from 0 to 3;

A and B are independent and have the structure selected from: —$(CH_2CH(OH)CH_2O)_jH$, and j is an integer selected from 0 to 3.

2. The polyfluoro lubricant composition of claim 1, wherein A is —H.

3. The polyfluoro lubricant composition of claim 1, wherein A is —$CH_2CH(OH)CH_2OH$.

4. The polyfluoro lubricant composition of claim 1, wherein A is —$CH_2CH(OH)CH_2OCH_2CH(OH)CH_2OH$.

5. The polyfluoro lubricant composition of claim 1, wherein B is —H.

6. The polyfluoro lubricant composition of claim 1, wherein B is —$CH_2CH(OH)CH_2OH$.

7. The polyfluoro lubricant composition of claim 1, wherein B is —$CH_2CH(OH)CH_2OCH_2CH(OH)CH_2OH$.

8. The polyfluoro lubricant composition of claim 1, wherein w is 0.

9. The polyfluoro lubricant composition of claim 1, wherein the number average molecular weight of the one or more compounds of Formula I is between about 300 Da to about 9000 Da.

10. The polyfluoro lubricant composition of claim 9, wherein the number average molecular weight of the one or more compound of Formula I is between about 900 Da to about 1800 Da.

11. The polyfluoro lubricant composition of claim 1 further comprising a liquid medium.

12. The polyfluoro lubricant composition of claim 11, wherein the liquid medium is a polyfluoroether (PFPE) polymer.

* * * * *